US005314555A

United States Patent [19]

Fukazawa

[11] Patent Number: 5,314,555

[45] Date of Patent: May 24, 1994

[54] PRODUCTION OF RUBBER THREAD - WOUND GOLF BALLS

[75] Inventor: Fumio Fukazawa, Tokyo, Japan

[73] Assignee: Bridgestone Sports Co., Ltd., Tokyo, Japan

[21] Appl. No.: 12,441

[22] Filed: Feb. 2, 1993

[30] Foreign Application Priority Data

Feb. 3, 1992 [JP] Japan ..... 4-47478

[51] Int. Cl.[5] ..... A63B 45/00; A63B 37/00

[52] U.S. Cl. ..... 156/170; 156/146; 156/172; 273/216; 273/231

[58] Field of Search ..... 156/146, 145, 170, 172; 242/173, 18 EW, 3, 74; 273/216, 231

[56] References Cited

U.S. PATENT DOCUMENTS

| | | | |
|---|---|---|---|
| 3,044,614 | 7/1962 | Hanscom | 242/173 |
| 3,735,862 | 5/1973 | Nimmo, Jr. | 242/74 |
| 4,422,588 | 12/1983 | Nowisch | 242/56 R X |

FOREIGN PATENT DOCUMENTS

| | | | |
|---|---|---|---|
| 51-126470 | 11/1976 | Japan . | |
| 55-96170 | 7/1980 | Japan . | |
| 2040870 | 9/1980 | United Kingdom | 156/172 |

*Primary Examiner*—Jeff H. Aftergut

*Attorney, Agent, or Firm*—Sughrue, Mion, Zinn, Macpeak & Seas

[57] ABSTRACT

Disclosed herein is a process for producing quality thread-wound golf balls efficiently by fixing the starting end and/or terminating end of rubber thread rapidly in a simple manner. When a core is wound with rubber thread to form a layer of wound rubber thread, a hot-melt adhesive (in the molten state) is dropped on the starting end of rubber thread resting on the core surface and is subsequently allowed to solidify, so that the stating end of rubber thread is fixed to the core. After the completion of winding, the terminating end of rubber thread is fixed to the layer of wound rubber thread with a hot-melt adhesive in the same manner as mentioned above.

11 Claims, 1 Drawing Sheet

PRODUCTION OF RUBBER THREAD - WOUND GOLF BALLS

BACKGROUND OF THE INVENTION

1. Field of the Invention

The present invention relates to a process for producing thread-wound golf balls consisting of a core, a layer of rubber thread wound thereon, and a covering layer. More particularly, the present invention relates to a process for producing thread-wound golf balls, in which the starting end and/or terminating end of the rubber thread is fixed in an improved manner.

2. Description of the Prior Art

Thread-wound golf balls are conventionally produced by winding a rubber thread on a core and forming a covering layer thereon. The core may be a "liquid center" which is a rubber bag (center bag) filled with a liquid or paste, or it may be a "solid center" made of solid rubber. To wind a rubber thread on the core (center), it is necessary to fix the starting and terminating ends of the rubber thread. This is accomplished in several ways as follows. One method consists of winding a rubber thread 2 to 3 times around the core such that the starting end is held down by the subsequent turns of the rubber thread. Another method consists of bonding the starting end to the core surface with a drop of adhesive (Japanese Patent Publication No. 49985/1986). A further method employed in the case the core is a liquid center (which is frozen before winding) consists of dropping water on the starting end resting on the surface of the frozen core, thereby causing the water to freeze (Japanese Patent Laid-open No. 126470/1976). The terminating end may be fixed by passing it under the last turn of the rubber thread or by means of an adhesive (Japanese Patent Publication No. 49985/1986).

The above-mentioned methods pose several problems as follows. The terminating end passed under the last turn of the rubber thread is liable to become loose unless it is sufficiently long. On the other hand, an excessively long terminating end will project from the covering mold in the subsequent step, leading to rejects. Moreover, passing the starting or terminating end under the first or last turn of the rubber thread can hardly be automated; it has to be done by troublesome manual operation.

This problem may be solved by fixing with an adhesive; however, the use of an adhesive presents another problem. The adhesive takes time to cure. The adhesive is sticky and liable to attract foreign matter. The adhesive does not satisfactorily work on the frozen liquid center. The adhesive remaining on the core affects the performance of the golf ball.

Fixing with frozen water also presents problems. Water causes rusting and moisture condensation. Water vaporizes to adversely affect the winding machine. It can be applied to the liquid center only.

As mentioned above, the conventional methods for fixing the ends of rubber thread are not necessarily satisfactory from the standpoint of production efficiency and product quality. There has been a demand for the development of a new process for the efficient production of thread-wound golf balls of high quality.

The present invention was completed under the above-mentioned circumstances.

SUMMARY OF THE INVENTION

It is an object of the present invention to provide a process for efficiently producing thread-wound golf balls of high quality, said process permitting the starting end and/or terminating end of rubber thread to be fixed easily in a short time.

DETAILED DESCRIPTION OF THE INVENTION

The present inventors carried out a series of researches, which led to the finding that the above-mentioned object can be achieved by the use of a hot-melt adhesive of thermoplastic resin. According to the present invention, it is possible to fix the starting end and/or terminating end of rubber thread. To do this, the hot-melt adhesive in the molten state is dropped on the starting end resting on the core surface or on the terminating end resting on the layer of wound rubber thread. The hot-melt adhesive is subsequently allowed to solidify. This method can also be used in the case where the core is a solid center or liquid center. This method offers an advantage that the hot-melt adhesive solidifies rapidly, thereby fixing the end of rubber thread certainly and easily in a short time, without requiring the troublesome manual operation for passing the end of rubber thread under the turn of rubber thread. This method offers additional advantages. It can be easily automated. The hot-melt adhesive does not bring about moisture condensation which adversely affects the winding machine. The hot-melt adhesive fixing the end of rubber thread melts again and migrates into the layer of wound rubber thread when the covering layer is formed. Therefore, the hot-melt adhesive does not affect the performance of the golf ball.

The present invention is embodied in a process for producing thread-wound golf balls by winding a rubber thread on a core and covering the layer of wound rubber thread, characterized in that the winding of rubber thread is initiated by placing the starting end of rubber thread on the core surface, dropping a hot-melt adhesive (in the molten state) on the starting end, and allowing the hot-melt adhesive to solidify, thereby fixing the starting end of rubber thread to the core.

The present invention is also embodied in a process for producing rubber thread-wound golf balls by winding a rubber thread on a core and covering the layer of wound rubber thread, characterized in that the winding of rubber thread is completed by placing the terminating end of rubber thread on the layer of wound rubber thread, dropping a hot-melt adhesive (in the molten state) on the terminating end, and allowing the hot-melt adhesive to solidify, thereby-fixing the terminating end of rubber thread to the layer of wound rubber thread.

In the case where the starting end or terminating end of rubber thread is fixed by the method of the present invention, the other end may be fixed by the conventional method. However, it is desirable to fix both ends by the method of the present invention for the production of quality golf balls.

The invention will be described in more detail in the following.

Figure 1:
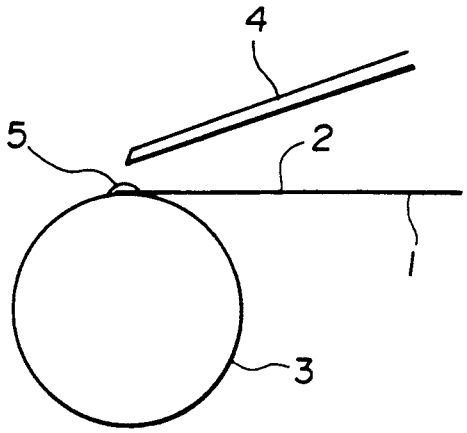
FIG. 1 is a schematic illustrating the operation for fixing the starting end of rubber thread according to the process of the present invention.

According to the present invention, the process for producing thread-wound golf balls is characterized in that the winding of rubber thread is accomplished by fixing the starting end and/or terminating end of rubber thread with a hot-melt adhesive. This procedure is illustrated in FIG. 1. The starting end 2 of rubber thread 1 is placed on the core 3, and the hot-melt adhesive (in the molten state) 5 is dropped from the nozzle 4 on the starting end 2. The hot-melt adhesive is allowed to solidify so as to fix the starting end 2 to the core 3. A similar procedure may be used to fix the terminating end of rubber thread to the layer of wound rubber thread.

There are no specific restrictions on the hot-melt adhesive, so long as it melts upon heating and solidifies rapidly at normal or room temperature. The one which melts at 60 to 150° C., especially 70 to 110° C., is desirable. Preferred examples of the hot-melt adhesive include "S-dyne 8512LS" (made by Sekisui Chemical Co. , Ltd. ) and "Ren-melt RF-1051" (made by Rengo Co., Ltd.) which are both a thermoplastic resin.

Figure 2:
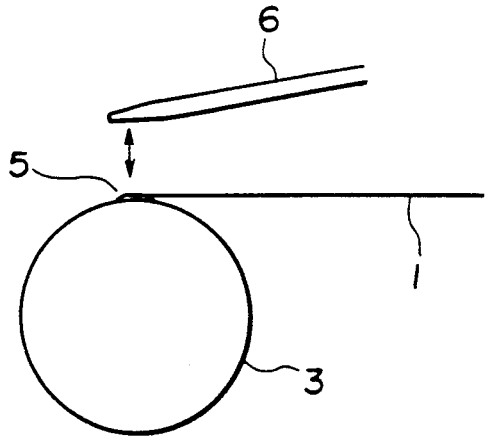
FIG. 2 is a schematic illustrating a different mode of the above-mentioned method.

According to the present invention, the hot-melt adhesive in the molten state is dropped from the nozzle on the end of rubber thread resting on the core surface or the layer of wound rubber thread. The amount of the hot-melt adhesive is not specifically limited; however, it should preferably be 0.01 to 0.2 g. With an insufficient amount, the hot-melt adhesive may not firmly fix the end of rubber thread. With an excess amount, the hot-melt adhesive takes a long time to solidify and fix the end of rubber thread. With an adequate amount (0.01 to 0.2 g), the hot-melt adhesive takes about 5 seconds to solidify. Time required to solidify may be reduced to about 1 second if the hot-melt adhesive 5 is flattened by the spatulate presser 6 immediately after its dropping, as shown in FIG. 2.

According to the present invention, the starting end of rubber thread may be fixed satisfactorily to the core of any type, solid center or frozen liquid center. It is quite easy and simple to fix the starting end and terminating end of rubber thread by dropping the hot-melt adhesive. The procedure does not need the troublesome operation of passing the terminating end of rubber thread under the last turn of the wound rubber thread. Therefore, the procedure may be automated with ease or accomplished very easily by manual operation in a short time.

According to the present invention, the process for producing thread-would golf balls consists of fixing the starting end of rubber thread to a core with a hot-melt adhesive, winding the rubber thread (in the stretched state) on the core, thereby forming a layer of wound rubber thread, fixing the terminating end of rubber thread to the layer of wound rubber thread with a hot-melt adhesive, and covering the layer of wound rubber thread. The winding of rubber thread may be accomplished in the usual way (random winding or great circle winding) using an ordinary winding machine.

According to the present invention, it is not necessary to use water to fix the starting end of rubber thread and it is possible to fix the starting end of rubber thread certainly in a short time. Therefore, the process of the present invention does not involve the possibility that the winding machine is adversely affected by water and the rubber thread becomes loose in the beginning of winding. It permits the layer of rubber thread to be formed invariably as desired. It also permits the terminating end of rubber thread to be fixed certainly in a short time. As the result, the winding step can be immediately followed by the covering step, without the fear of rubber thread becoming loose during transfer.

In practicing the process of the present invention, it is possible to properly select the core diameter and the thickness of the layer of wound rubber thread depending on the size of desired golf balls (large balls or small balls).

After the winding of rubber thread on the core, the layer of wound rubber thread is covered with a covering layer. In this way there are obtained thread -wound golf balls. The covering layer is made of any known material such as balata resin, ionomer resin, polyester resin, and nylon resin. The covering layer is formed in the usual way such as injection molding and compression molding. In case of a balata cover, the covering layer is finally vulcanized by dipping process or gas process.

According to the process of the present invention, the ends of rubber thread are fixed with a hot-melt adhesive. The hot-melt adhesive for fixing melts again and migrates into the layer of wound rubber thread when the covering layer if formed. Therefore, the hot-melt adhesive has nothing to do with the performance of the golf ball.

Incidentally, the covering layer is provided with dimples in the usual way.

EXAMPLES

The invention will be described in more detail with reference to the following example and comparative example, which are not intended to restrict the scope of the invention.

EXAMPLE

A core of solid rubber, 28 mm in diameter and 17.5 g in weight, was wound with a rubber thread, 2 mm wide and 0.5 mm thick, stretched about 8 times, to form a 5.5 -mm thick layer of wound rubber thread. (The resulting ball is 39 mm in diameter).

To fix the starting end of the rubber thread to the core, 0.02 g of a hot-melt adhesive ("S-dyne 8512LS" made by Sekisui Chemical Co., Ltd.) in the molten state was dropped from the nozzle on the starting end of the rubber thread resting on the core surface. The hot-melt adhesive was flattened by a spatulate presser and allowed to solidify by itself. The terminating end of the thread was also fixed to the layer of wound rubber thread in the same manner as above. After dropping and flattening, the hot-melt adhesive took about 1 second to solidify to fix the ends of the rubber thread.

The layer of wound rubber thread was covered with a covering layer of Surlyn by press molding. Thus there was obtained a rubber thread-wound golf ball.

The golf ball was found to have a weight and outside diameter as shown in Table 1. The golf ball was tested for durability and flight characteristics in the following manner. The results are shown in Table 1.

DURABILITY

The golf ball conditioned at 40° C. was topped on two parts. Then, using an RDM/C hitting machine (with the drum rotating at 1000 rpm, corresponding to the driver HIS=45 m/s), the golf ball was hit 60 times to examine for deformation. Durability was rated by counting the number of deformed golf balls out of 6 golf balls tested.

FLIGHT CHARACTERISTICS

Using a "Miya-shot Robot Driving Tester" (made by Miyamae Co., Ltd.), the golf ball was hit by a driver at a head speed of 45 m/s. The carry, the total flight distance (carry+run), and the angle of elevation were measured.

COMPARATIVE EXAMPLE

A golf ball was produced in the same manner as in Example, except that the starting end and terminating end of rubber thread were fixed in the conventional manner. That is, a rubber thread was wound 2 to 3 times around the core and its starting end was held down by its turn so as to be fixed to the core. The terminating end of rubber thread was fixed by passing it under the last turn of rubber thread. The fixing operations were carried out carefully to prevent the starting end from becoming loose and the terminating end from projecting from the cover. Great difficulties were encountered in fixing the ends of rubber thread.

The golf ball was found to have a weight and outside diameter as shown in Table 1. The golf ball was tested for durability and flight characteristics in the same manner as mentioned above. The results are shown in Table 1.

TABLE 1

| | Example | Comparative Example |
|---|---|---|
| Weight (g) | 45.1 | 45.0 |
| Outside diameter (mm) | 42.66 | 42.68 |
| Performance | | |
| Durability | 0/6 | 0/6 |
| Carry (m) | 219.5 | 218.4 |
| Total flight distance (m) | 228.3 | 230.0 |
| Angle of elevation | 12.07 | 12.04 |

It is noted from Table 1 that the golf ball produced according to the process of the present invention is comparable in performance to the one produced by the conventional process. Moreover, it was confirmed that the process of the present invention is more efficient and simpler than the conventional one.

EFFECT OF THE INVENTION

According to the present invention, the process for producing thread-wound golf balls is characterized in that the layer of wound rubber thread on the core is formed by fixing the starting end and/or terminating end of rubber thread with a hot-melt adhesive. Fixing with a hot-melt adhesive offers the advantage of preventing the starting end from becoming loose and the terminating end from projecting from the cover, unlike the conventional fixing method which consists of passing the end of rubber thread under the turn of rubber thread. Moreover, it is reliable and by far simpler than the conventional fixing method.

Since a hot-melt adhesive solidifies in 1 to 5 seconds as mentioned above, the process of the present invention permits the end of rubber thread to be fixed much faster than the process which employs an adhesive. In addition, a hot-melt adhesive forms the fixing part which is not sticky and hence does not attract foreign matter. The fixing part of a hot-melt adhesive melts again when the covering layer is formed; therefore, it produces no adverse effect on the performance of the golf ball.

The process of the present invention can be accomplished in a much shorter time than the conventional process which consists of fixing the starting end of rubber thread by causing water to freeze on the frozen core. Since water is not used, there is no possibility of the machine being adversely affected by water. The method for fixing by freezing water cannot be applied to winding rubber thread on the solid center. By contrast, the method for fixing with a hot-melt adhesive can be applied to winding rubber thread on both the frozen liquid center and solid center.

What is claimed is:

1. A process for producing thread-wound golf balls by winding a rubber thread on a core and covering a layer of wound rubber thread, characterized in that the winding of rubber thread is initiated by a method comprising the steps of:

placing a starting end of rubber thread on a core surface;

dropping a hot-melt adhesive (in a molten state) on the starting end; and flattening the hot-melt adhesive via application of pressure to reduce the time required to solidify the adhesive, thereby fixing the starting end of rubber thread to the core.

2. A process according to claim 1, wherein said core is one of solid or liquid.

3. A process according to claim 1, wherein said hot-melt adhesive melts between 60° C. and 150° C.

4. A process according to claim 3, wherein said hot-melt adhesive melts between 70° C. and 110° C.

5. A process according to claim 1, wherein said flattening step is carried out via a spatulate presser.

6. A process for producing thread-wound golf balls by winding a rubber thread on a core and covering a layer of wound rubber thread, characterized in that the winding of rubber thread is completed by a method comprising the steps of:

placing a terminating end of rubber thread on a layer of wound rubber thread;

dropping a hot-melt adhesive (in a molten state) on the terminating end; and flattening the holt-melt adhesive via application of pressure to reduce the time required to solidify the adhesive, thereby fixing the terminating end of rubber thread to the layer of wound rubber thread.

7. A process according to claim 6, wherein while said layer of wound rubber thread is being covered, said hot-melt adhesive. migrates into said layer of wound rubber thread.

8. A process according to claim 6, wherein said core is one of solid or liquid.

9. A process according to claim 6, wherein said hot-melt adhesive melts between 60° C. and 150° C.

10. A process according to claim 9, wherein said hot-melt adhesive melts between 70° C. and 110° C.

11. A process according to claim 6, wherein said flattening step is carried out via a spatulate presser.

* * * * *